US005650789A

United States Patent [19]

Elliott et al.

[11] Patent Number: 5,650,789

[45] Date of Patent: Jul. 22, 1997

[54] RETRACTABLE ANTENNA SYSTEM

[75] Inventors: Michael Elliott; Matti Martiskainen, both of Poriya Illit, Israel

[73] Assignee: Galtronics Ltd., Tiberias, Israel

[21] Appl. No.: 541,913

[22] Filed: Oct. 10, 1995

[51] Int. Cl.[6] ..... H01Q 1/24

[52] U.S. Cl. ..... 343/702; 343/895; 343/900

[58] Field of Search ..... 343/702, 895, 343/900, 901

[56] References Cited

U.S. PATENT DOCUMENTS

| | | | |
|---|---|---|---|
| 3,087,117 | 4/1963 | Mitchell | 343/702 |
| 4,095,229 | 6/1978 | Elliott | 343/715 |
| 4,121,218 | 10/1978 | Irwin et al. | 343/702 |
| 4,190,841 | 2/1980 | Harada | 343/903 |
| 4,598,295 | 7/1986 | Murphy | 343/702 |
| 4,725,845 | 2/1988 | Phillips | 343/702 |
| 4,860,024 | 8/1989 | Egashira | 343/702 |
| 4,862,182 | 8/1989 | Egashira | 343/702 |
| 4,868,576 | 9/1989 | Johnson, Jr. | 343/702 |
| 4,958,382 | 9/1990 | Imanishi | 343/702 |
| 5,177,492 | 1/1993 | Tomura et al. | 343/702 |
| 5,204,687 | 4/1993 | Elliott et al. | 343/702 |
| 5,374,937 | 12/1994 | Tsunekawa et al. | 343/702 |
| 5,446,469 | 8/1995 | Makino | 343/702 |
| 5,479,178 | 12/1995 | Ha | 343/702 |
| 5,504,494 | 4/1996 | Chatzipetros et al. | 343/702 |

FOREIGN PATENT DOCUMENTS

| | | | |
|---|---|---|---|
| 301175 | 4/1988 | European Pat. Off. . | |
| 0245603 | 11/1991 | Japan | 343/702 |
| WO94/10720 | 10/1993 | WIPO . | |

*Primary Examiner*—Donald T. Hajec
*Assistant Examiner*—Tan Ho
*Attorney, Agent, or Firm*—Ladas & Parry

[57] ABSTRACT

A retractable antenna system for an electrical device includes a rod antenna movable to an extended position or to a retracted position, an electrical coil carried by one end of the rod antenna and movable therewith to the extended and retracted positions, and a coil antenna carried by the electrical device coaxially with the rod antenna such as to enclose the electrical coil and to be electromagnetically coupled thereto in the retracted position of the rod antenna and electrical coil.

20 Claims, 5 Drawing Sheets

RETRACTABLE ANTENNA SYSTEM

FIELD AND BACKGROUND OF THE INVENTION

The present invention relates to a retractable antenna system for electrical devices. The invention is particularly useful with respect to the retractable antenna system described in our U.S. Pat. No. 5,204,687, and application Ser. No. 08/485,992 filed Jul. 6, 1995 now U.S. Pat. No. 5,606,327, and is therefore described below with respect to such antenna systems.

The above-cited patent and copending application disclose retractable antenna systems for electrical devices, particularly cordless telephones, which antenna systems include a rod antenna (sometimes called a whip), and a coil antenna carried by the outer end of the rod antenna. The rod antenna is movable to either a retracted position within the housing wherein substantially only the coil antenna is disposed externally of the housing, or to an extended position externally of the housing wherein substantially the complete rod antenna and coil antenna are disposed externally of the housing. In the preferred embodiments therein described, the rod antenna and coil antenna are pretuned to the same frequency such that in the extended position of the antenna system, the rod antenna is enabled for use in long range operation, and in the retracted position of the antenna system, the coil antenna is enabled for use in short range operation.

In such constructions, the coil antenna carried at the outer end of the rod antenna is of substantial mass. Therefore, when the rod antenna is in its extended position, the long length of the rod antenna, together with the substantial mass of the coil antenna at the outer end of the rod antenna, cause the rod antenna to become very floppy, i.e., to readily flex or vibrate with substantial displacement magnitudes. This may be very disturbing to the user carrying the electrical device and attached antenna assembly; moreover, it can also result in breakage of the rod antenna.

OBJECTS AND BRIEF SUMMARY OF THE INVENTION

An object of the present invention is to provide a retractable antenna system having advantages in the above respects, and particularly one which decreases the floppiness of the antenna system in the extended position of the rod antenna.

According to the present invention, there is provided a retractable antenna system for an electrical device, comprising: a rod antenna movably mounted to the electrical device to an extended position or a retracted position with respect to the electrical device; an electrical coil carried by one end of the rod antenna and movable therewith to the extended and retracted positions; and a coil antenna carried by the electrical device such as to be electromagnetically coupled to the electrical coil in the retracted position of the rod antenna and electrical coil.

According to further features in the described preferred embodiment, the electrical device is mounted within a housing having an opening through which the rod antenna moves to its extended and retracted positions with respect to the housing. The rod antenna has an outer end externally of the housing and an inner end within the housing. The electrical coil is carried on the outer end of the rod antenna, and the coil antenna is mounted on the housing on the external side thereof coaxial with the opening.

As will be described more particularly below, the foregoing features of the present invention substantially reduce the mass at the outer end of the antenna rod and therefore substantially reduce the floppiness of the antenna system in its extended position. Reduced antenna noise has also been observed in some constructions of the novel retractable antenna system.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
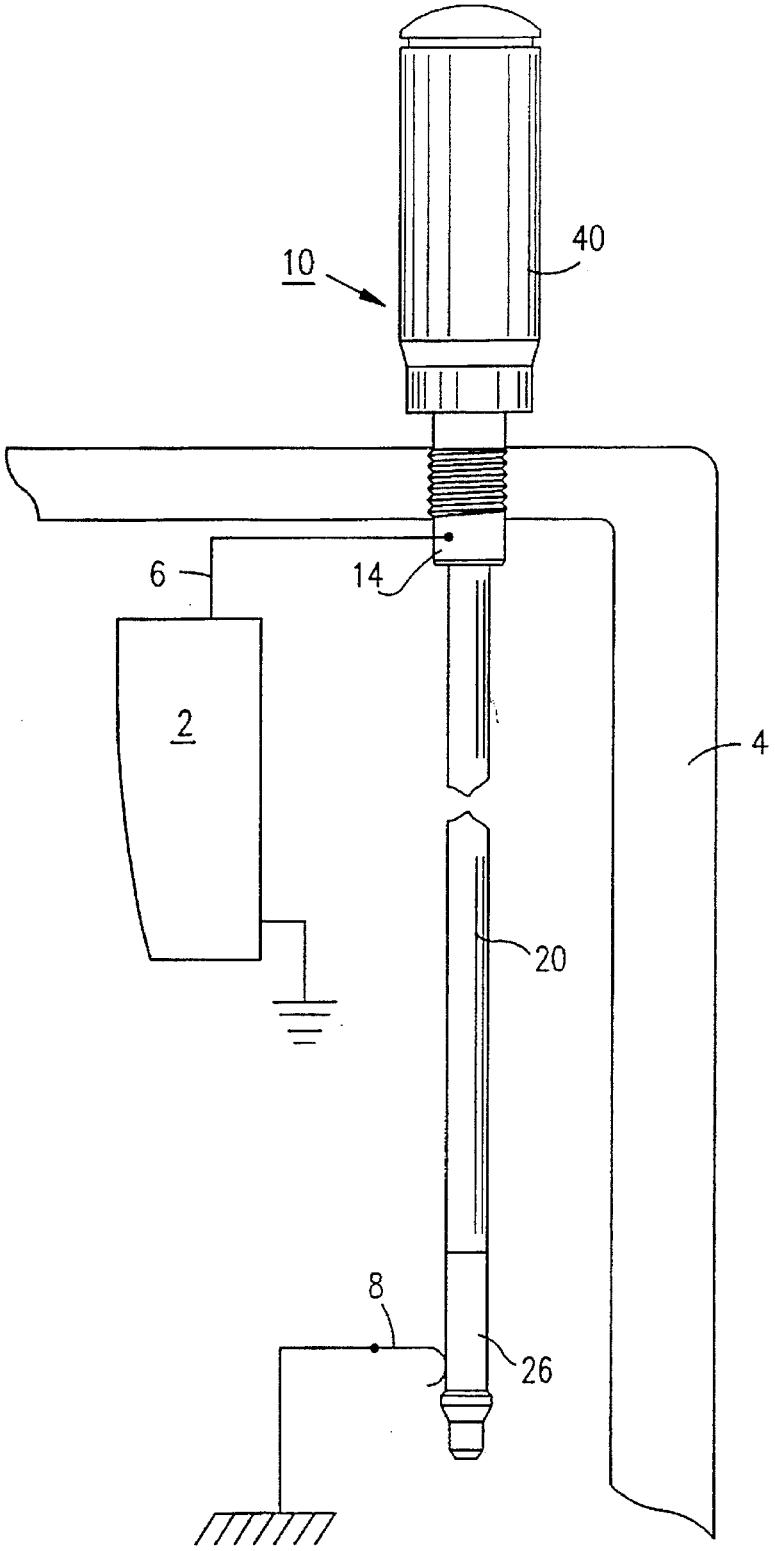
FIG. 1 illustrates one form of retractable antenna system constructed in accordance with the present invention, the antenna system being shown in its retracted position.
Figure 2:
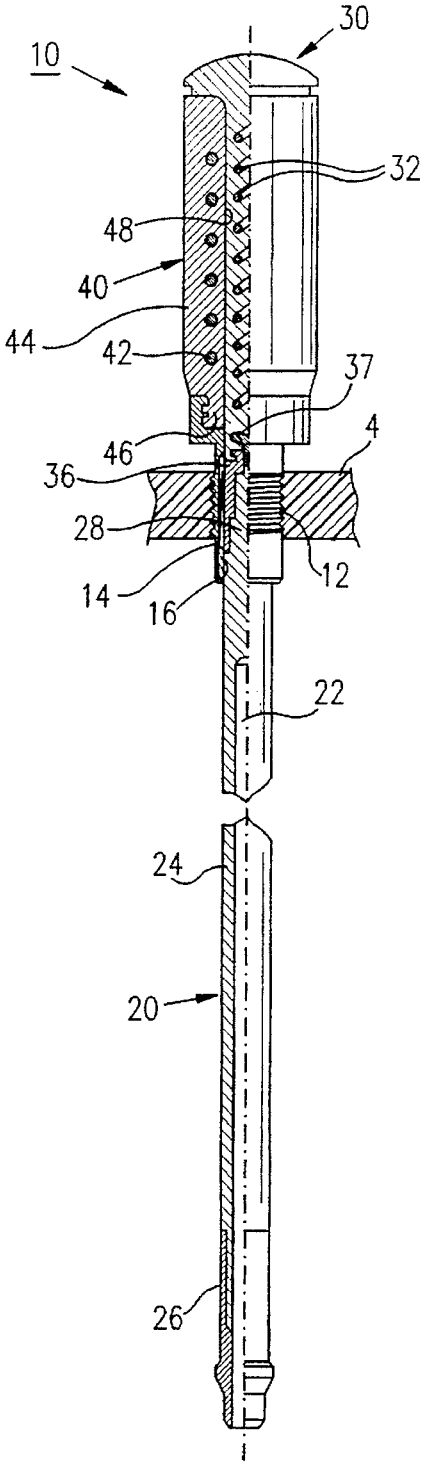
FIG. 2 is a partial sectional view of the antenna system of FIG. 1, illustrating the antenna system in its retracted position.
Figure 3:
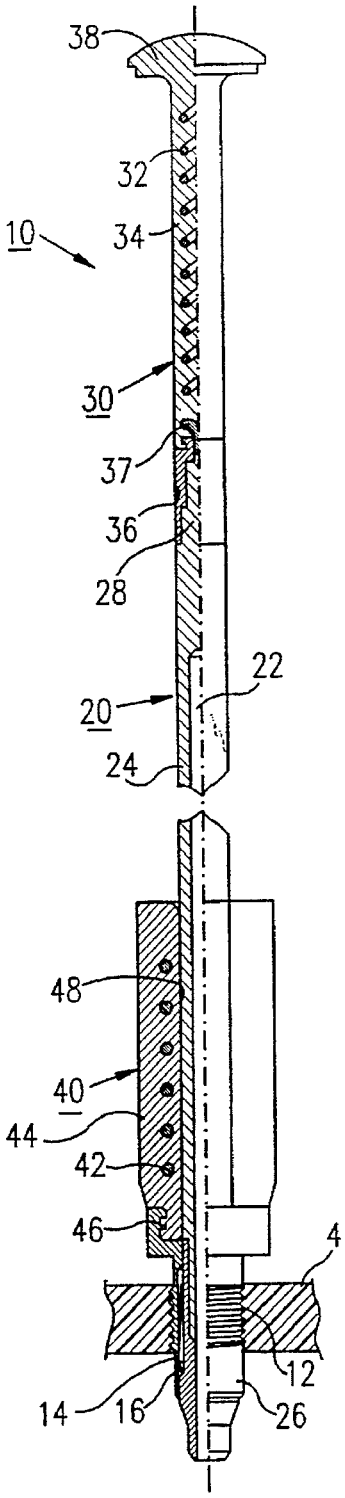
FIG. 3 is a partial sectional view of the antenna system of FIG. 1, illustrating the antenna system in its extended position.

FIGS. 1–3 illustrate an electrical device including an electrical circuit, schematically indicated by block 2, enclosed within a housing 4 and connected by an electrical lead 6 to a retractable antenna system, generally designated 10, constructed in accordance with the present invention. The electrical device may be, for example, a telephone transmitter-receiver in a cordless telephone, in which the antenna system 10 is moved to its retracted position (FIGS. 1 and 2) for short-range operation, and to its extended position (FIG. 3) for long-range operation. Housing 4 further includes an electrical contact 8 which is grounded and which is engaged by a part of the antenna in its retracted position in one case, as will be described more particularly below.

As more particularly seen in FIGS. 2 and 3, housing 4 is formed with an opening 12 fixedly receiving a metal sleeve 14 of the retractable antenna system 10. Lead 6 from the electrical circuit 2 is electrically connected to metal sleeve 14. Sleeve 14, in turn, includes an inner metal sleeve 16 constituting an electrical contact fixed to housing 4. As described below, contact 16 is selectively engageable by a second electrical contact carried by the inner end of the antenna assembly 10 in the extended position of that antenna, or a third electrical contact carried by the antenna assembly in the retracted position of that assembly.

The retractable antenna system 10 includes a rod antenna, generally designated 20, mounted coaxially within opening 12 of housing 4 so as to be enclosed by the metal sleeve 14 and the electrical contact 16 carried by the housing. Rod antenna 20 includes a metal rod 22 enclosed by an insulating sheath 24 for the complete length of the metal rod, except for its inner end which is enclosed and engaged by a metal sleeve 26. Metal sleeve 26 thus constitutes the second electrical contact mentioned above engageable by the fixed electrical contact 16 carried by the housing 4 in the extended position of the rod antenna as shown in FIG. 3.

The outer end of the insulating sheath 24 of the rod antenna 20 is reduced in diameter, as shown at 28, for receiving a coil assembly, generally designated 30, carried at the upper end of the rod antenna 20. Coil assembly 30 includes an electrical coil 32 also completely insulated by an insulating sheath 34. The lower end of coil assembly 30 includes a metal sleeve 36 electrically connected by a metal collar 37 to coil 32. The outer end of coil assembly 30 terminates in an enlarged cap 38 formed with a flattened undersurface. As will be described more particularly below, metal sleeve 36 constitutes the third electrical contact connected to coil 32 and engageable by electrical contact 16 of the housing 4 in the retracted position of the antenna assembly.

Antenna assembly 10 further includes a coil antenna, generally designated 40, fixedly mounted to housing 4 by means of the metal sleeve 14 coaxial with opening 12 in the housing. Coil antenna 40 includes an electrical coil 42 embedded in dielectric material 44 formed with a reduced-diameter base 46 at its lower end for attachment to metal sleeve 14, and further formed with an axial passageway 48 for receiving coil assembly 30 of the rod antenna 20. As shown in FIGS. 1 and 2, coil antenna 40 is thus fixed to housing 4 such as to enclose, and to be electromagnetically coupled to, the electrical coil 32 carried at the upper end of the rod antenna 20 in the retracted position of the rod antenna. The upper end of the coil antenna 40 is flattened so as to be engageable by the flattened undersurface of cap 38 at the outer end of coil assembly 30 in the retracted position of the rod antenna as shown in FIGS. 1 and 2.

The antenna assembly illustrated in FIGS. 1–3 operates as follows:

When the electrical device 2 enclosed within housing 4 is to be used for short-range operation, the rod antenna 20 is moved to its retracted position as shown in FIGS. 1 and 2. In this retracted position, the antenna rod 20 is substantially completely enclosed within housing 4 except for its coil assembly 30 which is exposed externally of the housing coaxially within the coil antenna 40 fixed to the housing. In this retracted position of the antenna assembly, the grounded electrical contact 8 engages electrical contact 26 at the inner end of the rod antenna 20, thereby grounding the metal rod 22 and rendering the rod antenna ineffective. On the other hand, in this retracted position of the antenna assembly, electrical coil 32 is connected via its collar 37 and its electrical contact 36 to electrical contact 16 carried by housing 4; also, electrical coil 32 is now aligned with the fixed coil antenna 40 so as to be electromagnetically coupled to that antenna, thereby enabling the antenna coil 42 to radiate or receive energy.

When the electrical device 2 is to be used for long-range operation, rod antenna 20 is moved to its extended position as shown in FIG. 3. In this position, electrical contact 16 now engages metal sleeve 26 at the inner end of the rod antenna 20, which thereby electrically connects the circuit 2 via lead 6 to the metal rod 22 and renders that rod effective to radiate or receive energy.

In this extended position of the antenna assembly, electrical coil 32 is electrically insulated by the upper end of sheath 24 from rod 22, thereby electrically disconnecting electrical coil 32 from the metal rod 22. In some applications, however, it may be desirable also to include electrical coil 32 as part of the rod antenna 22 in the extended position of the antenna assembly, in which case electrical coil 32 would be electrically connected to the metal rod 22.

It will thus be seen that since electrical coil 32 is used only for feeding the coil antenna 40 in the retracted position of the antenna assembly, electrical coil 32 may be made of relatively small-diameter wire and may include a relatively thin insulating sheath so that its mass would be substantially less than that if the electrical coil were also used for radiating or receiving the energy. Accordingly, the mass at the upper end of the rod antenna is substantially reduced, thereby also substantially reducing the floppiness of the rod antenna in its extended position. In addition, the coil antenna 40 fixed to the housing 4 and receiving the rod antenna 20, provides additional support to the rod antenna in its extended position, thereby further reducing its floppiness.

As shown in FIG. 1, the rod antenna may be disabled from use in its retracted position by the engagement of its metal contact 26 with the grounded contact 8 carried within the housing 4 when the electrical coil 32 is electrically connected to the electrical contact 16.

Figure 4:
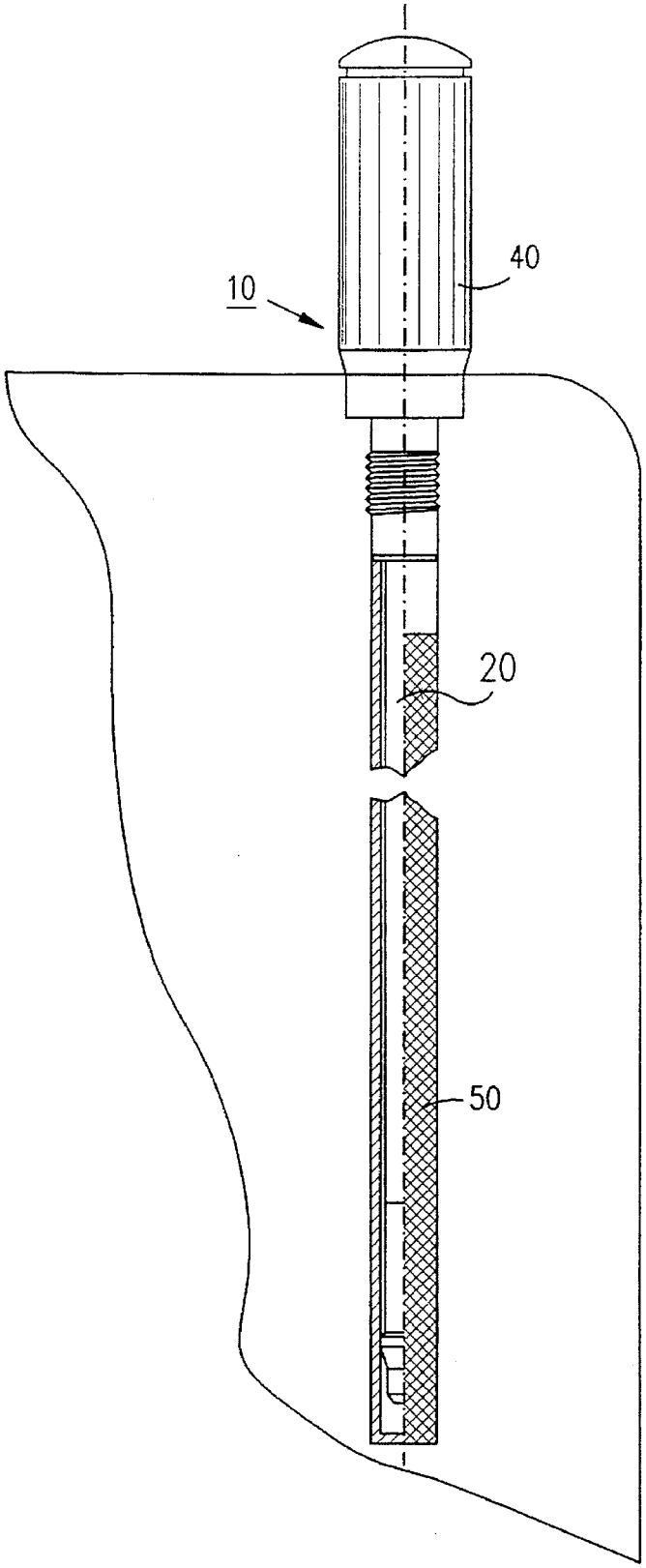
FIGS. 4 and 5 are views corresponding to that of FIG. 1 but illustrating two variations in the structure of the antenna system effective in the retracted position of the rod antenna.

FIG. 4 illustrates another arrangement for doing this, wherein housing 4 is provided with an electrical shielding tube, shown at 50, enclosing the rod antenna 20 in its retracted position.

Figure 5:
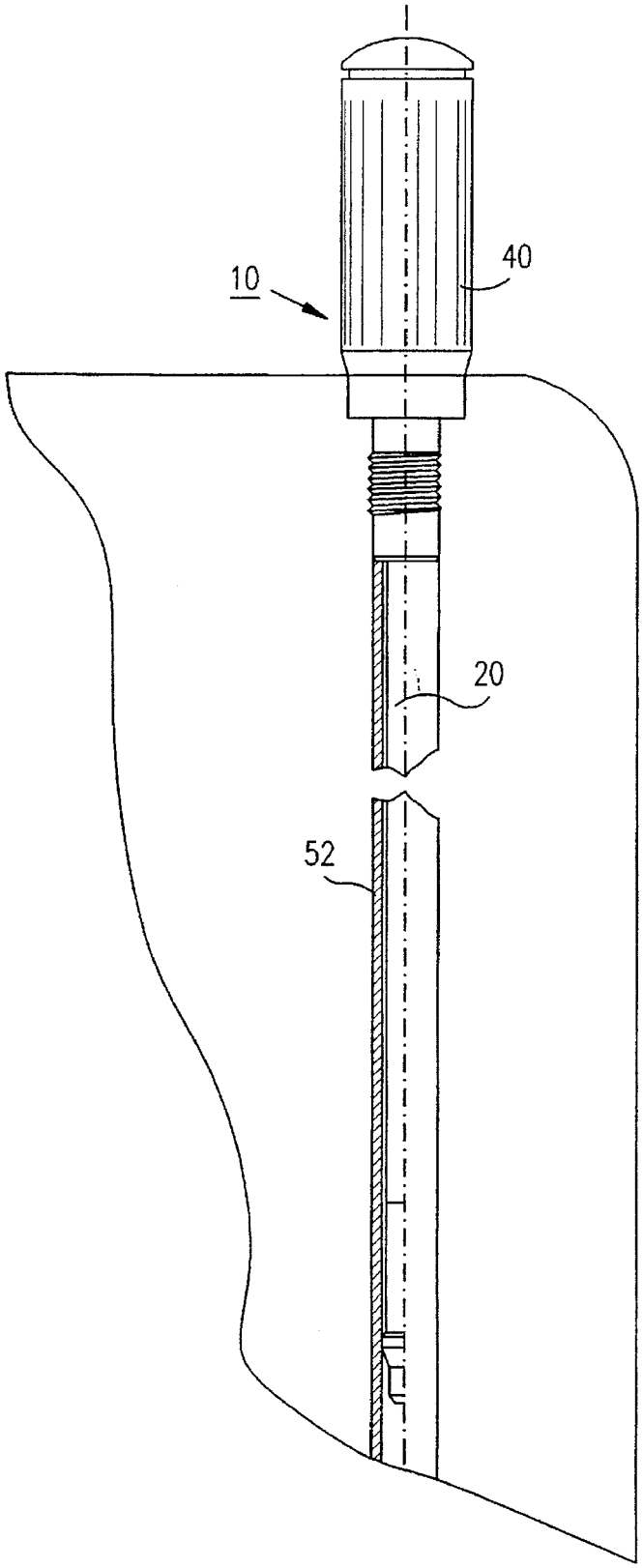

FIG. 5 illustrates a further alternative, wherein the housing is provided with a coaxial metal tube 52 enclosing the rod antenna 20 in its retracted position and forming a coaxial transmission line with it.

While the invention has been described with respect to several preferred embodiments, it will be appreciated that these are set forth merely for purposes of example, and that many other variations, modifications and applications of the invention may be made.

We claim:

1. A retractable antenna system, comprising:

an electrical device;

a rod antenna mounted to said electrical device and movable to an extended position or a retracted position with respect to said electrical device;

an electrical coil carried by one end of the rod antenna and movable therewith to said extended and retracted positions; and a coil antenna carried by said electrical device such as to be electromagnetically coupled to said electrical coil in the retracted position of said rod antenna and said electrical coil, said coil antenna being operative to radiate or receive energy only when electromagnetically coupled to said electrical coil when said electrical coil is in said retracted position.

2. The antenna system according to claim 1, wherein said rod antenna has an outer end which carries a cap engageable with said coil antenna in the retracted position of said rod antenna.

3. The antenna system according to claim 1, wherein said electrical device is housed within a housing having an opening through which said rod antenna moves to its extended and retracted positions with respect to said housing;

said rod antenna having an outer end externally of the housing and an inner end within said housing;

said electrical coil being carried on the outer end of said rod antenna;

said coil antenna being mounted on said housing on the external side thereof coaxial with said opening.

4. The antenna system according to claim 3, wherein said system further comprises:

a first electrical contact fixed to said housing adjacent to said opening;

a second electrical contact carried by and electrically connected to said rod antenna and engageable by said first electrical contact in the extended position of the rod antenna;

and a third electrical contact carried by the rod antenna, electrically connected to said electrical coil, and engageable by said first electrical contact in the retracted position of the rod antenna.

5. The antenna system according to claim 4, wherein said rod antenna includes a metal rod enclosed by an insulating sheath, said electrical coil being electrically insulated from said metal rod.

6. The antenna system according to claim 5, wherein said third electrical contact is in the form of a metal sleeve located between said insulating sheath and said electrical coil and electrically connected to said electrical coil.

7. The antenna system according to claim 6, wherein said electrical coil is covered by an insulating layer and carries at its outer end a cap engageable with said coil antenna in the retracted position of said rod antenna.

8. The antenna system according to claim 4, wherein said housing includes a further electrical contact connected to ground and engageable with said second electrical contact in the retracted position of the rod antenna.

9. The antenna system according to claim 4, wherein said housing includes an electrical shielding tube enclosing the rod antenna in the retracted position of the rod antenna.

10. The antenna system according to claim 4, wherein said housing includes a coaxial metal tube enclosing the rod antenna in the retracted position of the rod antenna and forming a coaxial transmission line therewith.

11. A retractable antenna system for an electrical device mounted within a housing and having an opening therethrough for said antenna system; said antenna system comprising:

a rod antenna movable through said opening to an extended position externally of said housing or to a retracted position within the housing, said rod antenna having an outer end externally of the housing in both its extended and retracted positions;

an electrical coil carried by said outer end of the rod antenna and movable therewith to said extended and retracted positions; and a coil antenna carried by said electrical device externally of the housing and coaxial with said opening and said rod antenna such as to enclose said electrical coil and to be electromagnetically coupled thereto in the retracted position of the rod antenna and the electrical coil, said coil antenna being operative to radiate or receive energy only when electromagnetically coupled to said electrical coil when said electrical coil is in said retracted position.

12. The antenna system according to claim 11, wherein said system further comprises:

a first electrical contact fixed to said housing adjacent to said opening;

a second electrical contact carried by the inner end of the rod antenna, electrically connected to said rod antenna, and engageable by said first electrical contact in the extended position of the rod antenna;

and a third electrical contact carried by the outer end of the rod antenna, electrically connected to said electrical coil, and engageable by said first electrical contact in the retracted position of the rod antenna.

13. The antenna system according to claim 12, wherein said rod antenna includes a metal rod enclosed by an insulating sheath, said electrical coil being electrically insulated from said metal rod.

14. The antenna system according to claim 13, wherein said third electrical contact, carried by the outer end of the rod antenna, is in the form of a metal sleeve located between said insulating sheath and said electrical coil and electrically connected to said electrical coil.

15. The antenna system according to claim 14, wherein said electrical coil is covered by an insulating layer and carries at its outer end a cap engageable with said coil antenna in the retracted position of said rod antenna.

16. The antenna system according to claim 12, wherein said housing includes a further electrical contact connected to ground and engageable with said second electrical contact, connected to said rod antenna, in the retracted position of the rod antenna.

17. The antenna system according to claim 12, wherein said housing includes an electrical shielding tube enclosing the rod antenna in the retracted position of the rod antenna.

18. The antenna system according to claim 12, wherein said housing includes a coaxial metal tube enclosing the rod antenna in the retracted position of the rod antenna and forming a coaxial transmission line therewith.

19. A retractable antenna system for an electrical device mounted within a housing, said antenna system comprising:

a rod antenna movable to an extended position or to a retracted position an electrical coil carried by said outer end of the rod antenna and movable therewith to said extended and retracted positions;

a coil antenna carried by said electrical device and coaxial with said rod antenna such as to enclose said electrical coil and to be electromagnetically coupled thereto in the retracted position of the rod antenna and the electrical coil, said coil antenna being operative to radiate or receive energy only when electromagnetically coupled to said electrical coil when said electrical coil is in said retracted position.

20. The antenna system according to claim 19, wherein said system further comprises:

a first electrical contact fixed to said housing;

a second electrical contact carried by the inner end of the rod antenna, electrically connected to said rod antenna, and engageable by said first electrical contact in the extended position of the rod antenna;

and a third electrical contact carried by the outer end of the rod antenna, electrically connected to said electrical coil, and engageable by said first electrical contact in the retracted position of the rod antenna.

* * * * *